US010957467B2

(12) United States Patent
Ranganathan et al.

(10) Patent No.: US 10,957,467 B2
(45) Date of Patent: Mar. 23, 2021

(54) COATED OVERHEAD CONDUCTOR

(71) Applicant: GENERAL CABLE TECHNOLOGIES CORPORATION, Highland Heights, KY (US)

(72) Inventors: Sathish Kumar Ranganathan, Indianapolis, IN (US); Vijay Mhetar, Carmel, IN (US); Srinivas Siripurapu, Carmel, IN (US); Cody R. Davis, Maineville, OH (US); Frank E. Clark, Jersey Shore, PA (US)

(73) Assignee: GENERAL CABLE TECHNOLOGIES CORPORATION, Highland Heights, KY (US)

( * ) Notice: Subject to any disclaimer, the term of this patent is extended or adjusted under 35 U.S.C. 154(b) by 0 days.

(21) Appl. No.: 14/592,520

(22) Filed: Jan. 8, 2015

(65) Prior Publication Data

US 2015/0194240 A1 Jul. 9, 2015

Related U.S. Application Data

(60) Provisional application No. 61/925,053, filed on Jan. 8, 2014.

(51) Int. Cl.

| | |
|---|---|
| ***H01B 13/14*** | (2006.01) |
| ***H01B 7/29*** | (2006.01) |
| *B05D 3/02* | (2006.01) |
| *B05D 7/20* | (2006.01) |
| *H01B 5/00* | (2006.01) |
| *B05B 7/14* | (2006.01) |

(52) U.S. Cl.

CPC ..... *H01B 7/292* (2013.01); *H01B 13/14* (2013.01); *B05B 7/14* (2013.01); *B05D 3/0218* (2013.01); *B05D 7/20* (2013.01); *H01B 5/002* (2013.01)

(58) Field of Classification Search

CPC combination set(s) only.
See application file for complete search history.

(56) References Cited

U.S. PATENT DOCUMENTS

| | | | | |
|---|---|---|---|---|
| 4,383,133 | A | 5/1983 | Lanfranconi | |
| 4,457,975 | A * | 7/1984 | Bahder | H01B 7/2813 264/171.16 |
| 4,513,173 | A | 4/1985 | Merry | |
| 4,801,501 | A | 1/1989 | Harlow | |
| 4,988,835 | A | 1/1991 | Shah | |
| 5,217,391 | A | 6/1993 | Fisher, Jr. | |
| 5,269,701 | A | 12/1993 | Leibfried | |
| 5,518,420 | A | 5/1996 | Pitschi | |
| 5,725,953 | A | 3/1998 | Onishi et al. | |
| 6,018,000 | A | 1/2000 | Keeny et al. | |
| 6,027,373 | A | 2/2000 | Gray | |
| 6,159,046 | A | 12/2000 | Wong | |
| 6,369,328 | B1 | 4/2002 | Munakata | |
| 7,015,395 | B2 | 3/2006 | Goldsworthy et al. | |
| 7,381,089 | B2 | 6/2008 | Hosier, Sr. | |
| 7,384,307 | B1 | 6/2008 | Wang | |
| 7,438,971 | B2 | 10/2008 | Bryant et al. | |
| 7,488,209 | B2 | 2/2009 | Vaccaro | |
| 7,527,512 | B2 | 5/2009 | Montena | |
| 7,637,774 | B1 | 12/2009 | Vaccaro | |
| 7,683,262 | B2 | 3/2010 | Guery et al. | |
| 7,752,754 | B2 | 7/2010 | Goldsworthy et al. | |
| 7,934,954 | B1 | 5/2011 | Chawgo et al. | |
| 7,935,890 | B2 | 5/2011 | Holzmueller et al. | |
| 7,939,764 | B2 | 5/2011 | Gottfried et al. | |
| 8,165,439 | B2 | 4/2012 | Overton | |
| 8,211,220 | B2 | 7/2012 | Kim | |
| 8,371,028 | B2 | 2/2013 | Goldsworthy et al. | |
| 8,535,033 | B2 | 9/2013 | Castiglioni et al. | |
| 8,857,733 | B1 * | 10/2014 | Galbraith | C23C 4/12 239/132.5 |
| 9,011,791 | B2 † | 4/2015 | Olver | |
| 9,741,467 | B2 | 8/2017 | Ranganathan et al. | |
| 2003/0047718 | A1 | 3/2003 | Narayan et al. | |
| 2004/0016503 | A1 * | 1/2004 | Stowe | B29C 47/0016 156/244.12 |
| 2004/0069524 | A1 | 4/2004 | Beauchamp | |

(Continued)

FOREIGN PATENT DOCUMENTS

| | | |
|---|---|---|
| CN | 101125979 A | 2/2008 |
| CN | 201408590 Y | 2/2010 |

(Continued)

OTHER PUBLICATIONS

Thomas, Shane; International Search Report and Written Opinion of the International Searching Authority, issued in International Application No. PCT/US2015/010619; dated Mar. 25, 2015; 8 pages.

Mou, Yuhui; First Office Action issued in Chinese Patent Application No. 201580011125.7; dated Mar. 20, 2017; 16 pages, including English translation.

Modern Practical Handbook for Electric Engineers, vol. 1; published Feb. 29, 2012, China Water & Power Press; pp. 686-688.

Second Office Action issued in Chinese Patent Application No. 201580011125.7; dated Mar. 5, 2018; 6 pages, including English translation.

Mehdaoui, Imed; Office Action issued in European Patent Application No. 15734821.0; dated Jun. 27, 2018; 4 pages.

(Continued)

*Primary Examiner* — Austin Murata
(74) *Attorney, Agent, or Firm* — Ulmer & Berne LLP

(57) ABSTRACT

A polymeric coating can be applied to an overhead conductor. The overhead conductor includes one or more conductive wires, and the polymeric coating layer surrounds the one or more conductive wires. The overhead conductor can operate at a lower temperature than a bare overhead conductor with no polymeric coating layer when tested in accordance with ANSI C119.4 method. Methods of applying a polymeric coating layer to an overhead conductor are also described herein.

16 Claims, 5 Drawing Sheets

(56) References Cited

U.S. PATENT DOCUMENTS

| | | | | |
|---|---|---|---|---|
| 2005/0045368 | A1* | 3/2005 | Keogh | H01B 7/295 174/120 R |
| 2005/0239983 | A1 | 10/2005 | Wille et al. | |
| 2006/0264563 | A1 | 11/2006 | Hanrahan et al. | |
| 2007/0023735 | A1 | 2/2007 | Biscoglio et al. | |
| 2007/0193767 | A1 | 8/2007 | Guery et al. | |
| 2008/0015298 | A1 | 1/2008 | Xiong et al. | |
| 2009/0155570 | A1 | 6/2009 | Bonnet et al. | |
| 2010/0076719 | A1 | 3/2010 | Lawry et al. | |
| 2010/0202741 | A1* | 8/2010 | Ryan | G02B 6/447 385/113 |
| 2010/0304270 | A1 | 12/2010 | Amin-Sanayei et al. | |
| 2011/0118403 | A1 | 5/2011 | Wood et al. | |
| 2011/0239451 | A1 | 10/2011 | Montena et al. | |
| 2011/0239455 | A1 | 10/2011 | Montena et al. | |
| 2012/0018190 | A1* | 1/2012 | Smedberg | B29C 47/0021 174/120 SC |
| 2012/0106591 | A1 | 5/2012 | Springer, III | |
| 2012/0129974 | A1 | 5/2012 | DeNotta et al. | |
| 2012/0186851 | A1 | 7/2012 | Winterhalter et al. | |
| 2012/0261158 | A1 | 10/2012 | Daniel et al. | |
| 2013/0167502 | A1 | 7/2013 | Wilson et al. | |
| 2013/0186670 | A1 | 7/2013 | Person | |
| 2014/0041925 | A1 | 2/2014 | Davis et al. | |
| 2014/0205804 | A1 | 7/2014 | Jones et al. | |
| 2015/0049992 | A1* | 2/2015 | Bauco | G02B 6/4401 385/100 |
| 2015/0194240 | A1 | 7/2015 | Ranganathan et al. | |
| 2015/0232653 | A1 | 8/2015 | Fujita et al. | |
| 2016/0042837 | A1 | 2/2016 | Ranganathan et al. | |
| 2017/0137659 | A1 | 5/2017 | Ranganathan et al. | |

FOREIGN PATENT DOCUMENTS

| | | | |
|---|---|---|---|
| CN | 102146249 | A | 8/2011 |
| CN | 102446578 | A | 5/2012 |
| CN | 102977700 | A | 3/2013 |
| CN | 103131274 | A | 6/2013 |
| CN | 203038717 | U | 7/2013 |
| DE | 3824608 | C1 | 8/1989 |
| EP | 2219267 | A1 | 8/2010 |
| FR | 2971617 | A1 | 8/2012 |
| JP | 2000-30543 | A | 1/2000 |
| JP | 2005-177572 | A | 7/2005 |
| JP | 2006-104395 | A | 4/2006 |
| JP | 4252875 | B2 | 4/2009 |
| JP | 2010-184351 | A | 8/2010 |
| JP | 2012-168330 | A | 9/2012 |
| JP | 2014025420 | A | 2/2014 |
| WO | 2006042764 | A2 | 4/2006 |
| WO | 2007034248 | A1 | 3/2007 |
| WO | 2010005756 | A1 | 1/2010 |
| WO | 2010042191 | A1 | 4/2010 |
| WO | 2010144520 | A1 | 12/2010 |
| WO | 2013164686 | A1 | 11/2013 |
| WO | 2016022687 | A1 | 2/2016 |
| WO | 2017083689 | A1 | 5/2017 |

OTHER PUBLICATIONS

O'Malley, Andrew; Office Action issued in Canadian Patent Application No. 2,936,147; dated May 27, 2020; 3 pages.

O'Malley, Andrew; Office Action issued in Canadian Patent Application No. 2,936,147; dated Jan. 16, 2020; 4 pages.

Kumar, Vikash; Examination Report issued in Indian Patent Application No. 201637023102; dated Dec. 23, 2019; 5 pages.

Mehdaoui, Imed; Examination Report issued in European Patent Application No. 15734821.0; dated Nov. 12, 2018; 4 pages.

Mehdaoui, Imed; Examination Report issued in European Patent Application No. 15734821.0; dated Apr. 17, 2018; 4 pages.

Tan, Isaac; Examination Report No. 1, issued in Australian Patent Application No. 2015204743; dated Feb. 6, 2018; 3 pages.

Mehdaoui, Imed; Extended European Search Report issued in European Patent Application No. 15734821.0; dated Jul. 5, 2017; 6 pages.

* cited by examiner
† cited by third party

COATED OVERHEAD CONDUCTOR

REFERENCE TO RELATED APPLICATION

The present application claims the priority of U.S. provisional application Ser. No. 61/925,053, entitled COATED HIGH VOLTAGE TRANSMISSION OVERHEAD CONDUCTOR, filed Jan. 8, 2014, and hereby incorporates the same application herein by reference in its entirety.

TECHNICAL FIELD

The present disclosure generally relates to polymeric coatings that lower the operating temperature of overhead high voltage electric conductors.

BACKGROUND

As the demand for electricity grows, there is an increased need for higher capacity electricity transmission and distribution lines. The amount of power a transmission line can deliver is dependent on the current-carrying capacity (ampacity) of the line. Such ampacity is limited, however, by the maximum safe operating temperature of the bare conductor that carries the current. Exceeding this temperature can result in damage to the conductor or other components of the transmission line. However, the electrical resistance of the conductor increases as the conductor rises in temperature or power load. A transmission line with a coating that reduces the operating temperature of a conductor would allow for a transmission line with lowered electrical resistance, increased ampacity, and the capacity to deliver larger quantities of power to consumers. Therefore, there is a need for a polymeric coating layer that has a low absorptivity in order to limit the amount of heat absorbed from solar radiation, a high thermal conductivity and emissivity in order to increase the amount of heat emitted away from the conductor, a high thermal resistance and heat aging resistance to boost life span and survival at high conductor temperatures, and which can be produced in a continuous and solvent-free process.

SUMMARY

In accordance with one embodiment, a method of applying a polymer coating to an overhead conductor includes surrounding the overhead conductor with a polymer composition and cooling the polymer composition to form a polymeric coating layer surrounding the overhead conductor. The polymeric coating layer has a thickness of about 10 microns to about 1,000 microns. The overhead conductor operates at a lower temperature than a bare overhead conductor when tested in accordance with ANSI C119.4. The polymer composition is essentially solvent free and the method is essentially continuous.

DETAILED DESCRIPTION

Figure 1:
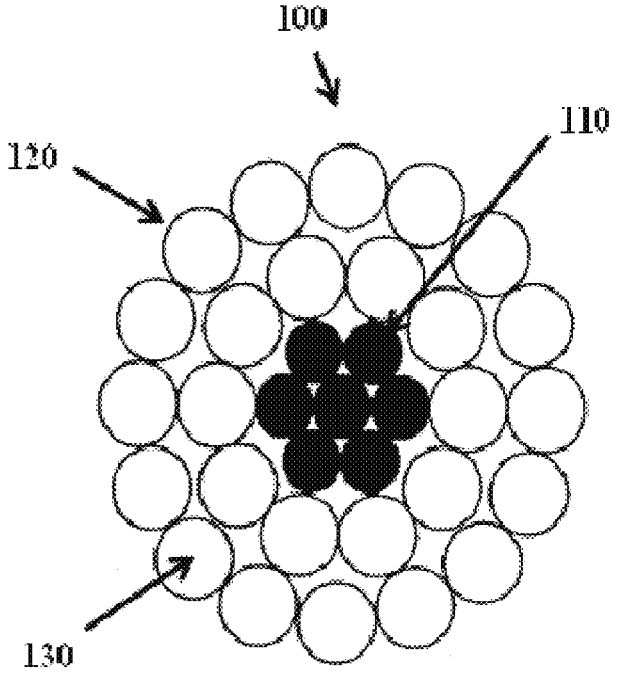
FIG. 1 depicts a cross-sectional view of a bare conductor having a plurality of core wires according to one embodiment.

A polymeric coating layer can be applied to a cable to reduce the operating temperature of the cable. For example, a high electricity transmission overhead conductor with a polymeric coating can operate at a lower temperature than a similarly constructed bare conductor when tested in accordance with American National Standards Institute ("ANSI") C119.4 methods. Such cables can generally be constructed from a plurality of conductive wires.

According to certain embodiments, a polymeric coating layer can be applied to a cable through a variety of methods. For example, the polymeric coating can be applied through one of a melt extrusion process, a power coating process, or a film coating process. The polymeric coating layer can be relatively thick.

Conductive Wires and Core Wires

A polymeric coating can be applied around a variety of cables including high voltage overhead electricity transmission lines. As can be appreciated, such overhead electricity transmission lines can be formed in a variety of configurations and can generally include a core formed from a plurality of conductive wires. For example, aluminum conductor steel reinforced ("ACSR") cables, aluminum conductor steel supported ("ACSS") cables, aluminum conductor composite core ("ACCC") cables and all aluminum alloy conductor ("AAAC") cables. ACSR cables are high-strength stranded conductors and include outer conductive strands, and supportive center strands. The outer conductive strands can be formed from high-purity aluminum alloys having a high conductivity and low weight. The center supportive strands can be steel and can have the strength required to support the more ductile outer conductive strands. ACSR cables can have an overall high tensile strength. ACSS cables are concentric-lay-stranded cables and include a central core of steel around which is stranded one, or more, layers of aluminum, or aluminum alloy, wires. ACCC cables, in contrast, are reinforced by a central core formed from one, or more, of carbon, glass fiber, or polymer materials. A composite core can offer a variety of advantages over an all-aluminum or steel-reinforced conventional cable as the composite core's combination of high tensile strength and low thermal sag enables longer spans. ACCC cables can enable new lines to be built with fewer supporting structures. AAAC cables are made with aluminum or aluminum alloy wires. AAAC cables can have a better corrosion resistance, due to the fact that they are largely, or completely, aluminum. ACSR, ACSS, ACCC, and AAAC cables can be used as overhead cables for overhead distribution and transmission lines.

As can be appreciated, a cable can also be a gap conductor. A gap conductor can be a cable formed of trapezoidal shaped temperature resistant aluminum zirconium wires surrounding a high strength steel core.

FIGS. 1, 2, 3, and 4 each illustrate various bare overhead conductors according to certain embodiments. Each overhead conductor depicted in FIGS. 1-4 can include the polymeric coating through one of a melt extrusion process, a powder coating process, or a film coating process. Additionally, FIGS. 1 and 3 can, in certain embodiments, be formed as ACSR cables through selection of steel for the core and aluminum for the conductive wires. Likewise, FIGS. 2 and 4 can, in certain embodiments, be formed as AAAC cables through appropriate selection of aluminum or aluminum alloy for the conductive wires.

As depicted in FIG. 1, certain bare overhead conductors 100 can generally include a core 110 made of one or more wires, a plurality of round conductive wires 120 locating around core 110, and a polymeric coating 130. The core 110 can be steel, invar steel, carbon fiber composite, or any other material that can provide strength to the conductor. The conductive wires 120 can be made of any suitable conductive material including copper, a copper alloy, aluminum, an aluminum alloy, including aluminum types 1350, 6000 series alloy aluminum, aluminum-zirconium alloy, or any other conductive metal.

Figure 2:
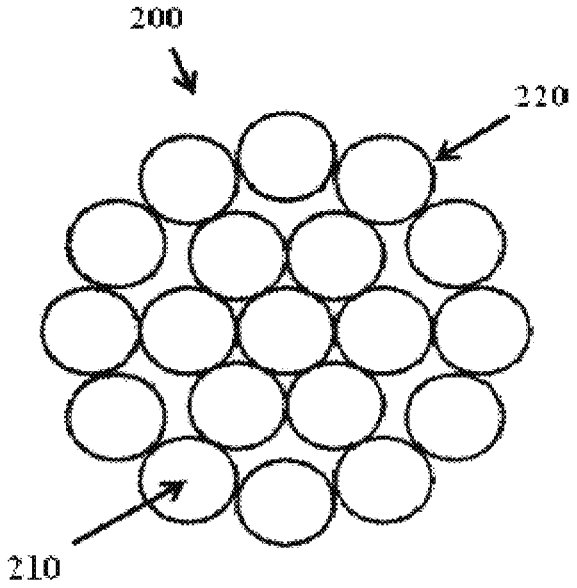
FIG. 2 depicts a cross-sectional view of a bare conductor without core wires according to one embodiment.

As depicted in FIG. 2, certain bare overhead conductors 200 can generally include round conductive wires 210 and a polymeric coating 220. The conductive wires 210 can be made from copper, a copper alloy, aluminum, an aluminum alloy, including aluminum types 1350, 6000 series alloy aluminum, an aluminum-zirconium alloy, or any other conductive metal.

Figure 3:
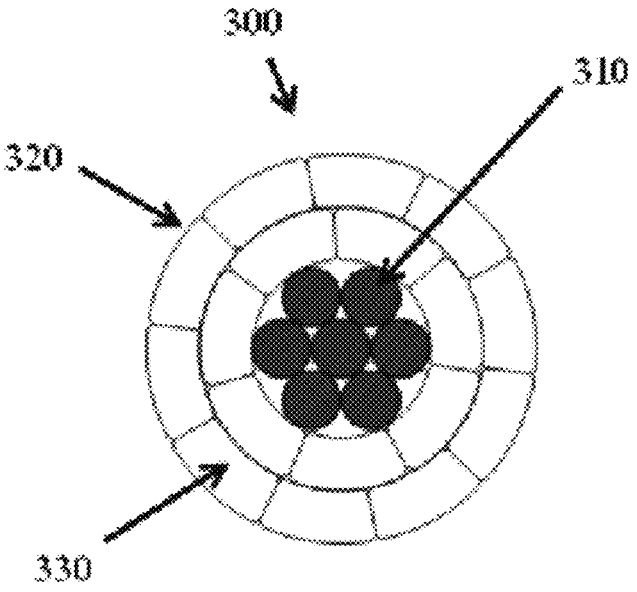
FIG. 3 depicts a cross-sectional view of a bare conductor formed of trapezoidal shaped conductive wires and having a plurality of core wires according to one embodiment.

As seen in FIG. 3, certain bare overhead conductors 300 can generally include a core 310 of one or more wires, a plurality of trapezoidal-shaped conductive wires 320 around a core 310, and the polymeric coating 330. The core 310 can be steel, invar steel, carbon fiber composite, or any other material providing strength to the conductor. The conductive wires 320 can be copper, a copper alloy, aluminum, an aluminum alloy, including aluminum types 1350, 6000 series alloy aluminum, an aluminum-zirconium alloy, or any other conductive metal.

Figure 4:
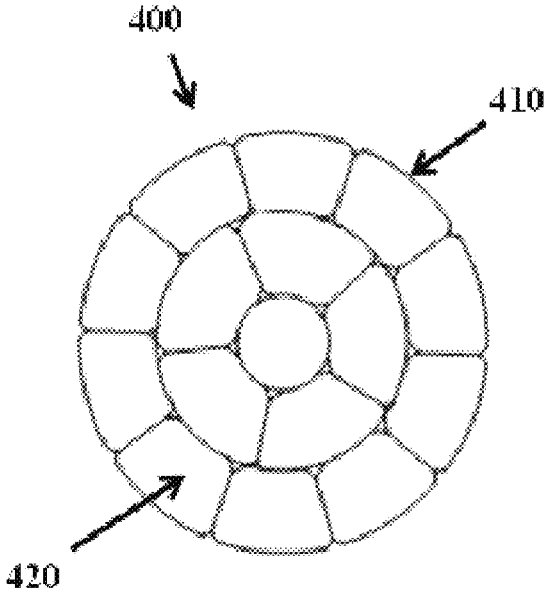
FIG. 4 depicts a cross-sectional view of a bare conductor formed from trapezoidal-shaped conductive wires and without core wires according to one embodiment.

As depicted in FIG. 4, certain bare overhead conductors 400 can generally include trapezoidal-shaped conductive wires 410 and a polymeric coating 420. The conductive wires 410 can be formed from copper, a copper alloy, aluminum, an aluminum alloy, including aluminum types 1350, 6000 series alloy aluminum, an aluminum-zirconium alloy, or any other conductive metal.

A polymeric coating can also, or alternatively, be utilized in composite core conductor designs. Composite core conductors are useful due to having lower sag at higher operating temperatures and their higher strength to weight ratio. As can be appreciated, a composite core conductor with the polymeric coating can have a further reduction in conductor operating temperatures due to the polymeric coating and can have both a lower sag and lower degradation of certain polymer resins in the composite from the lowered operating temperatures. Non-limiting examples of composite cores can be found in U.S. Pat. Nos. 7,015,395, 7,438,971, 7,752,754, U.S. Patent App. No. 2012/0186851, U.S. Pat. Nos. 8,371,028, 7,683,262, and U.S. Patent App. No. 2012/0261158, each of which are incorporated herein by reference.

As can be appreciated, conductive wires can also be formed in other geometric shapes and configurations. In certain embodiments, the plurality of conductor wires can also, or alternatively, be filled with space fillers or gap fillers.

Polymeric Coating Layer

According to certain embodiments, a polymeric coating layer can be formed from a suitable polymer or polymer resin. In certain embodiments, a suitable polymer can include one or more organic, or inorganic, polymers including homopolymers, copolymers, and reactive or grafted resins. More specifically, suitable polymers can include polyethylene (including LDPE, LLDPE, MDPE, and HDPE), polyacrylics, silicones, polyamides, poly ether imides (PEI), polyimides, polyamide imdies, PEI-siloxane copolymer, polymethylpentene (PMP), cyclic olefins, ethylene propylene diene monomer rubber (EPDM), ethylene propylene rubber (EPM/EPR), polyvinylidene difluoride (PVDF), PVDF copolymers, PVDF modified polymers, polytetrafluoroethylene (PTFE), polyvinyl fluoride (PVF), polychlorotrifluoroethylene (PCTFE), perfluoroalkoxy polymer (PFA), fluoroethylene-alkyl vinyl ether copolymer (FEVE), fluorinated ethylene propylene copolymer (FEP), ethylene tetrafluoroethylene copolymer (ETFE), ethylene chlorotrifluoroethylene resin (ECTFE), perfluorinated elastomer (FFPM/FFKM), fluorocarbon (FPM/FKM), polyesters, polydimethylsiloxane (PDMS), polyphenylene ether (PPE), and polyetheretherketone (PEEK), copolymers, blends, compounds, and combinations thereof.

In certain embodiments, the polymer can be an olefin, a fluorine based polymer, or a copolymer thereof. For example, a suitable polymer can be selected from the group consisting of polyethylene, polypropylene, polyvinylidene difluoride, fluoroethylene vinyl ether, silicone, acrylic, polymethyl pentene, poly(ethylene-co-tetrafluoroethylene), polytetrafluoroethylene, or a copolymer thereof.

As can be appreciated, a polymer can be treated and modified in a variety of ways. For example, the polymer can be partially, or fully, cross-linked in certain embodiments. In such embodiments, the polymer can be cross-linked through any suitable process including, for example, through chemical cross-linking processes, irradiation cross-linking processes, thermal cross-linking processes, UV cross-linking processes, or other cross-linking processes.

Alternatively, in certain embodiments, a polymer can be thermoplastic. The melting point of a suitable thermoplastic polymer can be 140° C., or more, in certain embodiments, and 160° C., or more, in certain embodiments.

The polymeric coating layer can include, or exhibit, other variations in structure or properties. For example, in certain embodiments, the polymeric coating layer can include one, or more, braids, ceramic fibers, adhesives yarns, or special tapes.

Additionally, in certain embodiments, the polymeric coating layer can be semi-conductive and can have a volume resistivity of $10^{12}$ ohm-cm or less; in certain embodiments a volume resistivity of $10^{10}$ ohm-cm or less; and, in certain embodiments, a volume resistivity of $10^{8}$ ohm-cm or less.

In certain embodiments, a polymeric coating layer can have a thermal deformation temperature of 100° C. or greater, and in certain embodiments, a thermal deformation of 130° C. or greater.

In certain embodiments, the polymeric coating layer can have a retention of elongation at break of 50%, or more, after 2000 hours of exterior weathering test in accordance with American Society for Testing and Materials (ASTM) 1960.

In certain embodiments, the polymeric coating layer can have a thickness of 10 mm or less; in certain embodiments, a thickness of 3 mm or less; and in certain embodiments, a thickness of 1 mm or less. As can be appreciated, the thickness of a polymeric coating layer can depend, in part, on the processes used to apply the polymer.

In certain embodiments, an increase in weight due to a polymeric coating layer relative to a weight of a bare conductor can be 15% or less, and in certain embodiments, can be 12% or less.

In certain embodiments, a polymeric coating layer can have an emissivity of 0.5 or greater, and in certain embodiments, an emissivity of 0.85 or greater.

In certain embodiments, a polymeric coating layer can have a solar absorptivity of 0.6 or less, and in certain embodiments, a solar absorptivity of 0.3 or less.

In certain embodiments, a polymeric coating layer can have a heat conductivity of 0.15 W/mK or more.

In certain embodiments, a polymeric coating layer can have a lightness 'L value' of 10 or more, and in certain embodiments, an L value of 30 or more. As can be appreciated, when L=0, the observed color can be black; and when L=100, the observed color can be white.

In certain embodiments, a polymeric coating layer can be substantially free of hydrorepellent additives, a hydrophilic additive, and/or a dielectric fluid.

As can be appreciated, a polymer resin can be used either alone or can include other additives, such as, for example, one or more of a filler, an infrared (IR) reflective additive, a stabilizer, a heat aging additive, a reinforcing filler, or a colorant.

Fillers

In certain embodiments, a polymeric coating layer can include one or more fillers. In such embodiments, the polymeric coating layer can contain such fillers at a concentration of about 0% to about 50% (by weight of the total composition) and such fillers can have an average particle size of 0.1 μm to 50 μm. The shapes of suitable filler particles can be spherical, hexagonal, platy, or tabular. Examples of suitable fillers can include metal nitrides, metal oxides, metal borides, metal silicides, and metal carbides. Specific example of suitable fillers can include, but are but not limited to, gallium oxide, cerium oxide, zirconium oxide, magnesium oxide, iron oxide, manganese oxide, chromium oxide, barium oxide, potassium oxide, calcium oxide, aluminum oxide, titanium dioxide, zinc oxide, silicon hexaboride, carbon tetraboride, silicon tetraboride, zirconium diboride, molybdenum disilicide, tungsten disilicide, boron silicide, cupric chromite, boron carbide, silicon carbide, calcium carbonate, aluminum silicate, magnesium aluminum silicate, nano clay, bentonite, carbon black, graphite, expanded graphite, carbon nanotubes, graphenes, kaolin, boron nitride, aluminum nitride, titanium nitride, aluminum, nickel, silver, copper, silica, hollow micro spheres, hollow tubes, and combinations thereof.

In certain embodiments, the filler can alternatively, or additionally, be a conductive carbon nanotube. For example, in certain embodiments, a polymeric coating layer can include single-wall carbon nanotube (SWCNT) and/or a multi-wall carbon nanotube (MWCNT).

In certain embodiments, a polymeric coating layer can include carbon black as a filler at a concentration of less than 5 wt %.

IR Reflective and Colorant Additives

According to certain embodiments, a polymeric coating layer can include one or more infrared reflective pigments or colorant additives. In such embodiments, an infrared reflective (IR) pigment or color additive can be included in the polymeric coating layer from 0.1 wt % to 10 wt %. Examples of suitable color additives can include cobalt, aluminum, bismuth, lanthanum, lithium, magnesium, neodymium, niobium, vanadium ferrous, chromium, zinc, titanium, manganese, and nickel based metal oxides and ceramics. Suitable infrared reflective pigments can include, but are not limited to, titanium dioxide, rutile, titanium, anatine, brookite, barrium sulfate, cadmium yellow, cadmium red, cadmium green, orange cobalt, cobalt blue, cerulean blue, aureolin, cobalt yellow, copper pigments, chromium green black, chromium-free blue black, red iron oxide, cobalt chromite blue, cobalt alumunite blue spinel, chromium green black modified, manganese antimony titanium buff rutile, chrome antimony titanium buff rutile, chrome antimony titanium buff rutile, nickel antimony titanium yellow rutile, nickel antimony titanium yellow, carbon black, magnesium oxide, alumina coated magnesium oxide, alumina coated titanium oxide, silica coated carbon black, azurite, Han purple, Han blue, Egyptian blue, malachite, Paris green, phthalocyanine blue BN, phthalocyanine green G, verdigris, viridian, iron oxide pigments, sanguine, caput mortuum, oxide red, red ochre, Venetian red, Prussian blue, clay earth pigments, yellow ochre, raw sienna, burnt sienna, raw umber, burnt umber, marine pigments (ultramarine, ultramarine green shade), zinc pigments (zinc white, zinc ferrite), and combinations thereof.

Stabilizers

In certain embodiments, one or more stabilizers can be included in a polymeric coating layer at a concentration of about 0.1% to about 5% (by weight of the total composition). Examples of such stabilizers can include a light stabilizers and dispersion stabilizers, such as bentonites. In certain polymeric coating compositions including an organic binder, antioxidants can also be used. Examples of suitable antioxidants can include, but are not limited to, amine-antioxidants, such as 4,4'-dioctyl diphenylamine, N,N'-diphenyl-p-phenylenediamine, and polymers of 2,2,4-trimethyl-1,2-dihydroquinoline; phenolic antioxidants, such as thiodiethylene bis[3-(3,5-di-tert-butyl-4-hydroxyphenyl) propionate], 4,4'-thiobis(2-tert-butyl-5-methylphenol), 2,2'-thiobis(4-methyl-6-tert-butyl-phenol), benzenepropanoic acid, 3,5 bis(1,1 dimethylethyl)4-hydroxy benzenepropanoic acid, 3,5-bis(1,1-dimethylethyl)-4-hydroxy-C13-15 branched and linear alkyl esters, 3,5-di-tert-butyl-4hydroxyhydrocinnamic acid C7-9-Branched alkyl ester, 2,4-dimethyl-6-t-butylphenol tetrakis{methylene3-(3',5'-ditert-butyl-4'-hydroxyphenol)propionate}methane or tetrakis{methylene3-(3',5'-ditert-butyl-4'-hydrocinnamate}methane, 1,1,3tris(2-methyl-4hydroxyl5butylphenyl)butane, 2,5,di-t-amyl hydroqunone, 1,3,5-tri methyl2,4,6tris(3,5 di tert butyl4hydroxybenzyl) benzene, 1,3,5tris(3,5 di tert butyl4hydroxybenzyl)isocyanurate, 2,2Methylene-bis-(4-methyl-6-tert butyl-phenol), 6,6'-di-tert-butyl-2,2'-thiodi-p-cresol or 2,2'-thiobis(4-methyl-6-tert-butylphenol), 2,2ethylenebis(4,6-di-t-butylphenol), triethyleneglycol bis{3-(3-t-butyl-4-hydroxy-5methylphenyl)propionate}, 1,3,5tris(4tert butyl3hydroxy-2,6-dimethylbenzyl)-1,3,5-triazine-2,4,6-(1H,3H,5H)trione, 2,2methylenebis{6-(1-methylcyclohexyl)-p-cresol}; and/or sulfur antioxidants, such as bis(2-methyl-4-(3-n-alkylthiopropionyloxy)-5-t-butylphenyl)sulfide, 2-mercaptobenzimidazole and its zinc salts, and pentaerythritol-tetrakis(3-lauryl-thiopropionate). In certain embodiments, the antioxidant can be phenyl phosphonic acid from Aldrich (PPOA), IRGAFOS® P-EPQ (phosphonite) from Ciba, or IRGAFOS® 126 (diphosphite).

Suitable light stabilizers can include, but are not limited to, bis(2,2,6,6-tetramethyl-4-piperidyl)sebaceate (Tinuvin® 770); bis(1,2,2,6,6-tetramethyl-4-piperidyl)sebaceate+methyl1,2,2,6,6-tetrameth-yl-4-piperidyl sebaceate (Tinuvin® 765); 1,6-hexanediamine, N,N'-Bis(2,2,6,6-tetramethyl-4-piperidyl)polymer with 2,4,6 trichloro-1,3,5-triazine, reaction products with N-butyl2,2,6,6-tetramethyl-4-piperidinamine (Chimassorb® 2020); decanedioic acid, Bis(2,2,6,6-tetramethyl-1-(octyloxy)-4-piperidyl)ester, reaction products with 1,1-dimethylethylhydroperoxide and octane (Tinuvin® 123); triazine derivatives (Tinuvin® NOR 371); butanedioc acid, dimethylester, polymer with 4-hydroxy-2,2,6,6-tetramethyl-1-piperidine ethanol (Tinuvin® 622); 1,3,5-triazine-2,4,6-triamine,N,N'''-[1,2-ethane-diyl-bis[[[4,6-bis-[butyl(1,2,2,6,6pentamethyl-4-piperdinyl) amino]-1,3,5-triazine-2-yl]imino-]-3,1-propanediyl]]bis[N',N''-dibutyl-N',N''bis(2,2,6,6-tetramethyl-4-pipe-ridyl) (Chimassorb® 119); and/or bis(1,2,2,6,6-pentamethyl-4-piperidinyl) sebacate (Songlight® 2920); poly[[6-[(1,1,3,3-tetramethylbutyl)amino]-1,3,5-triazine-2,4-diyl][2,2,6,6-tetramethyl-4-piperidinyl)imino]-1,6-hexanediyl[(2,2,6,6-tetramethyl-4-piperidinyl)imino]] (Chimassorb®944); Benzenepropanoic acid, 3,5-bis(1,1-dimethyl-ethyl)-4-hydroxy-.C7-C9 branched alkyl esters (Irganox® 1135); and/or isotridecyl-3-(3,5-di-tert-butyl-4-hydroxyphenyl)propionate (Songnox® 1077 LQ).

Coating Process

As described herein, one or more layers of a polymeric coating can be applied to a conductor such as an overhead cable. The one or more polymeric coating layers can be applied in a variety of manners. For example, in certain embodiments, the coating layer can be applied by an extrusion method, such as a melt extrusion. In other certain embodiments, the polymeric coating layer can be applied by powder coating, film coating or film wrapping, or by tape wrapping. In a tape wrapping process, adhesive or sealant can be used to help mechanically and/or chemically bond the tape to the conductor.

A melt extrusion process to apply a polymeric coating can generally include the steps of: a) melting a polymer, without a solvent to give a melted polymer; and b) extruding the melted polymer around the plurality of conductive wires to form the polymeric coating layer. In certain embodiments, the melt extrusion process can be essentially solvent free and can be operated continuously. Melting can also mean softening of polymers such as, for example, when the polymer is formed from amorphous polymers.

A powder coating process to apply a polymeric coating can generally include the steps of: a) spraying a powdered polymer onto an exterior surface of the plurality of conductive wires to give a sprayed conductor; and b) heating the sprayed conductor to melt, or soften, the powdered polymer around the plurality of conductive wires to form a layer. The powder coating process can be essentially solvent free and can be operated continuously.

A film coating processes to apply a polymeric coating can generally include the steps of: a) wrapping an exterior surface of the plurality of conductive wires with a polymeric film to give a wrapped conductor; and b) heating the wrapped conductor to a melting point temperature of the polymer to soften the polymer around the plurality of conductive wires and form a layer. A film coating process can be essentially solvent free and can be operated continuously.

As can be appreciated, the polymeric coating layer can be applied to a variety of cable shapes. Particularly, the polymeric coating layer is not restricted to certain perimeter shapes and can be applied to overhead conductors having, for example, non-round or non-smooth outer surfaces caused by gaps in the plurality of outer conductors. As can be further appreciated however, a perimeter shape can generally be circular.

In certain embodiments, a pre-treatment process can be used to prepare a surface of the cable for coating. Pre-treatment methods can include, but are not limited to, chemical treatment, pressurized air cleaning, hot water treatment, steam cleaning, brush cleaning, heat treatment, sand blasting, ultrasound, deglaring, solvent wipe, plasma treatment, and the like. For example, in certain embodiments, a surface of an overhead conductor can be deglared by sand blasting. In certain heat treatment processes, an overhead conductor can be heated to temperatures between 23° C. and 250° C. to prepare the surface of the conductor for the polymeric coating. As can be appreciated however, the temperature can be selected depending on the polymeric coating in certain embodiments. For example, when the polymeric coating consists of polyolefin polymers, the temperature of the conductor can be controlled to reach a temperature between 23° C. and 70° C. and when the polymeric coating consists of fluorine polymers the temperature range can be between 80° C. and 150° C.

In certain embodiments, the coating processes can be solvent free or essentially solvent free. Solvent free, or essentially solvent free can meant that no more than about 1% of a solvent is used in any of the processes, relative to the total weight of the product.

Melt Extrusion Process

In certain embodiments, a melt extrusion process can be used to apply a polymeric coating layer. In certain embodiments, the process can be essentially solvent free. In general, a melt extrusion process can include the extrusion of a melted polymer onto a conductor to form a polymeric layer. The polymeric layer can, in certain embodiments, be applied around an outer circumference of a conductor formed from a plurality of conductive wires. Alternatively, in certain embodiments, a plurality of polymeric layers can be applied to each, or certain, individual conductive wires in a conductor. For example, in certain embodiments, only the outermost conductive wires can be individually coated with a polymeric layer.

An understanding of an example melt extrusion process can be appreciated by explanation of an exemplary melt extrusion application of a polyvinylidene difluoride (PVDF) resin around a conductor. In such example embodiments, PVDF, or a PVDF resin, can be melted at temperatures of between 50° C. to 270° C. to form a melted polymer. The melted polymer can then be extruded over a bare overhead conductor using, for example, a single screw extruder to form an extruded coating layer. The extruder can be set at a convenient temperature depending on the coating material.

As can be appreciated, in certain embodiments, the polymeric coating material can be cured by a dynamic inline or post-coating process. The curing can be performed via a suitable chemical, thermal, mechanical, irradiation, UV, or E-beam method. Specific examples of such curing methods can include, but are not limited to, peroxide curing, monosil process curing, moisture curing process, mold or lead curing process and e-beam curing. The gel content (the cross-linked portion of the polymer which is insoluble in solvent) can be between 1% and 95%. A coating layer of 0.2 mm to 10 mm can be extruded in a continuous process according to certain embodiments, 0.2 mm to 3 mm in certain embodiments, and 0.2 mm to 1 mm according to certain embodiments.

As can be appreciated, a conformal polymeric coating layer can be formed through a melt extrusion process. To ensure conformability of a coating layer with an outer contour of the conductive wires, and adherence to the outer surfaces of the inner conductive wires, a vacuum can be applied between the conductor and the coating layer during extrusion. Alternatively, or additionally, compressive pressure can be applied to the exterior of the coating layer during heating or curing. Exterior pressure can be applied through, for example, a circular air knife. The conformal coating can improve the integrity of the overhead conductor.

The conformal coating can ensure that air gaps, or unfilled spaces, between a polymeric coating layer and an outer contour of the plurality of conductive wires are reduced relative to conventionally coated conductors. The outer contour of the conductive wires can be defined by an outline, shape or general packing structure of the conductive wires.

Using a melt extrusion method, curing and/or drying time can be greatly reduced, or completely eliminated, compared to conventional dip or spray methods of coating. As can be appreciated, the reduction in curing and/or drying times can allow for a higher line speed compared to other dip or spray processes. Additionally, existing melt extrusion processes can be readily adopted with few, or no, modifications to accommodate varying product specifications, whereas the traditional dip or spray processes can require new process steps.

Powder Coating Process

In certain embodiments, a powder coating process can be used to apply the one or more layers of the polymeric coating.

In such embodiments, a powder formed from the polymer can be sprayed onto an exterior surface of a conductor or conductive wires. In certain embodiments, an electro-static spray gun can be used to spray charged polymer powders for improved application of the powder to the conductor. In certain embodiments, the conductive wires can be preheated. After the powder is applied to the conductor or conductive wires, the sprayed conductive wires can be heated to a melting, or softening, temperature of the polymeric coating material. Heating can be performed using standard methods, including, for example, the application of hot air from a circular air knife or a heating tube. As can be appreciated, when a circular air knife is used, the melted polymer can be smoothed out under the air pressure and can form a continuous layer around the conductive wires.

The powder coating method also can be used to apply polymeric coating layers to a variety of conductor accessories, overhead conductor electrical transmission and distribution related products, or to other parts that can benefit from a reduced operating temperature. For example, dead-ends/termination products, splices/joints products, suspension and support products, motion control/vibration products (also called dampers), guying products, wildlife protection and deterrent products, conductor and compression fitting repair parts, substation products, clamps and other transmission and distribution accessories can all be treated using a powder coating process. As can be appreciated, such products can be commercially obtained from manufacturers such as Preformed Line Products (PLP), Cleveland, Ohio and AFL, Duncan, S.C.

Similar to melt extrusion processes, a coating layer applied through a powder coating process can optionally be cured inline with the powder coating process or through a post-coating process. Curing can be performed through a chemical curing process, a thermal curing process, a mechanical curing process, an irradiation curing process, a UV curing process, or an E-beam curing process. In certain embodiments, peroxide curing, monosil process curing, moisture curing, and e-beam curing can be used.

Similar to the melt extrusion process, a powder coating process can also be solvent free, or essentially solvent free, and can be continuously run.

Likewise, a powder coating process can be used to manufacture a conformable coating. In such embodiments, compressive pressure can be applied from the exterior of the coating layer during heating or curing to ensure conformability of the coating layer with the outer contour of the conductive wires, and adherence to the outline of the inner conductive wires.

The powder coating method can be used to form polymeric coating layers having a thickness of 500 μm or less in certain embodiments, 200 μm or less in certain embodiments, and 100 μm or less in certain embodiments. As can be appreciated, a low polymeric coating layer thickness can be useful in the formation of light weight, or low cost, overhead conductors.

Film Coating

In certain embodiments, a film coating process can be used to apply one or more layers of a polymeric coating.

In certain film coating processes, a film formed of a polymeric coating material can be wrapped around an exterior surface of a conductor. The film-wrapped conductor can then be heated to a melting temperature of the polymeric coating material to form the polymeric coating layer. Heating can be performed using standard methods, including, for example, hot air applied by a circular air knife or a heating tube. When a circular air knife is used, the melted polymer can be smoothed out under the air pressure and can form a continuous layer around the conductive wires.

In certain embodiments, a vacuum can be applied between the conductor and the coating layer to ensure conformability of the coating layer with the outer contour of the conductive wires, and adherence to the outline of the inner conductive wires. Alternatively or additionally, compressive pressure can be applied from the exterior of the coating layer during heating or curing.

Similar to melt extrusion processes, the coating layer can optionally be cured inline or through a post-coating process. Curing can be performed through a chemical curing process, a thermal curing process, a mechanical curing process, an irradiation curing process, a UV curing process, or an E-beam curing process. In certain embodiments, peroxide curing, monosil process Similar to the melt extrusion process, a powder coating process can also be solvent free or essentially solvent free and can be continuous.

In certain embodiments, adhesives can be included on an exterior surface of the plurality of conductive wires, and/or on the film to improve application. As can be appreciated, in certain embodiments, a tape can be used instead of a film.

The film coating process can be used to form polymeric coating layers having a thickness of 500 μm or less in certain embodiments, 200 μm or less in certain embodiments, and 100 μm or less in certain embodiments. As can be appreciated, a low thickness can be useful in the formation of light weight, or low cost, overhead conductors.

Characteristics of Coated Conductors

As can be appreciated, a polymeric coating can provide cables, such as overhead conductors, with a number of superior characteristics.

For example, in certain embodiments, a polymeric coating layer can provide a cable with a uniform thickness around the exterior of the conductor. Each method of applying the polymeric coating layer can compensate for differing amounts of unevenness. For example, traditional coating methods, such as dip or spray methods, can produce a coating layer that is uneven across the surface and can have a contour that is defined by the outer layer of the conductor wires as dip or spay methods can only provide a layer of up to 0.1 mm thickness. Conversely, a melt extrusion process, as described herein, can provide a coating thickness of up to 20 min evenly across the surface. Similarly, powder coating processes and film coating methods, as described herein, can also provide an even coating layer of lesser thickness.

Figure 5A:
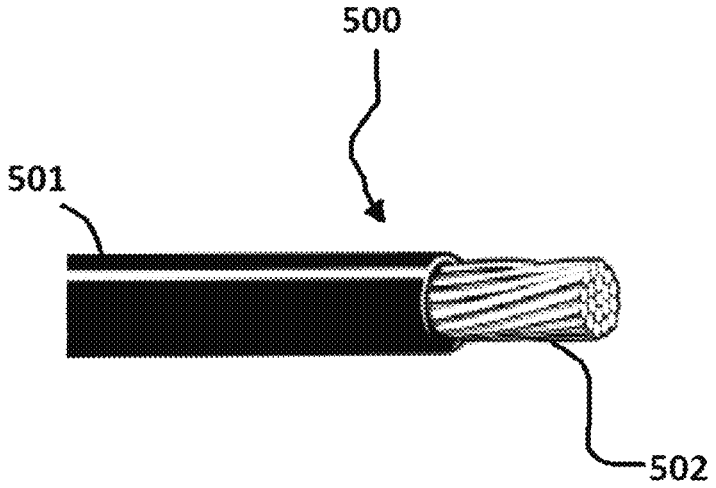
FIG. 5A depicts a side view of an overhead conductor having a polymeric coating layer around the central conductive wires according to one embodiment.
Figure 5B:
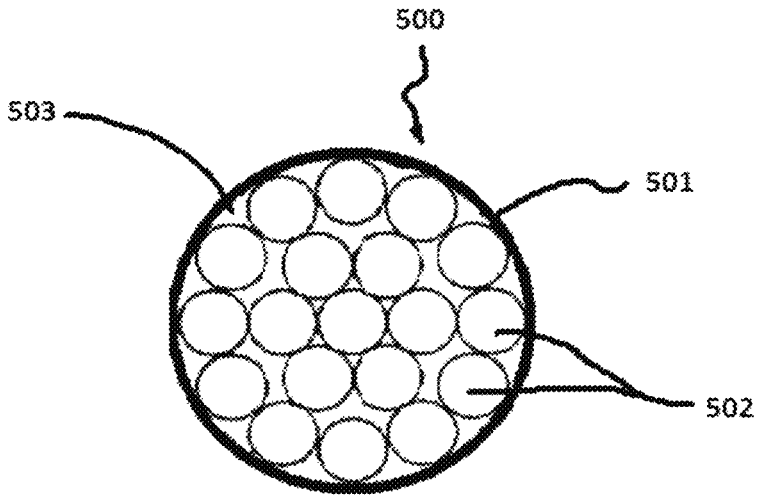
FIG. 5B depicts a cross-sectional view of an overhead conductor having a polymeric coating layer around the central conductive wires according to one embodiment.
Figure 5C:
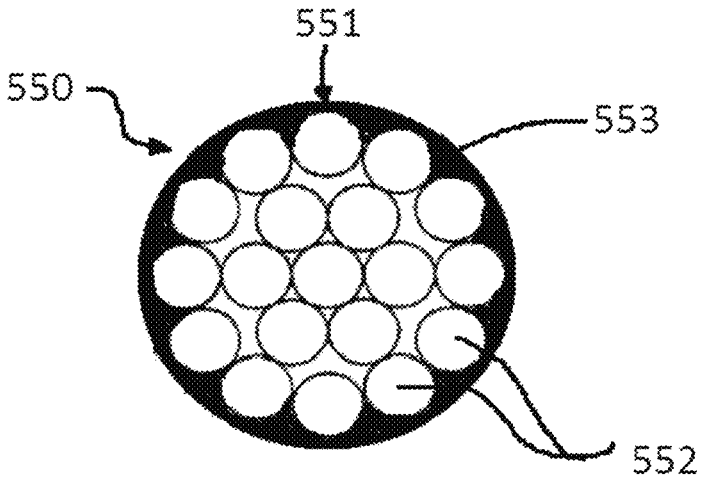
FIG. 5C depicts a cross-sectional view of an overhead conductor having a polymeric coating layer around the central conductive wires according to one embodiment.

FIGS. 5A and 5B depict a side view and a cross-sectional view respectively of a coated conductor 500 with a conformal polymeric coating layer 501. The polymeric coating layer is shaped by the extrusion head and has a pre-defined thickness. The coating layer 501 surrounds the interior conductor wires 502, and shields the wires 502 from the weather elements. Gaps 503 can be present between the polymeric coating layer 501 and the conductive wires 502. FIG. 5C depicts another conductor 550 that has a conformable polymeric coating layer 551. In FIG. 5C, the polymeric coating layer 551 fills the gaps or spaces 553 in the cross-sectional area surrounding the outer contours of the conductor wires 552. In this embodiment, the coating layer adheres to the outer surfaces of the outermost layer of the conductive wires 502.

In certain embodiments, the unfilled spaces between the polymeric coating layer and the outer contour of the conductive wires can be reduced compared to the unfilled spaces generated by traditional coating methods. The tight packing can be achieved using a range of techniques including, for example, the application of vacuum pressure during coating. In certain embodiments, adhesives can alternatively, or additionally, be used on the outer surfaces of the conductor wire to facilitate tight packing of the polymeric material in the spaces.

As another advantage, a polymer coating layer can provide, in certain embodiments, conductor wires with increased mechanical strength relative to that of a bare conductor. For example, in certain embodiments, coated conductors can have a minimum tensile strength of 10 MPa and can have a minimum elongation at break of 50% or more.

As another advantage, a polymeric coating layer can, in certain embodiments, decrease the operating temperature of a conductor. For example, a polymeric coating layer can lower the operating temperature compared to a bare conductor by 5° C. or more in certain embodiments, by 10° C. or more in certain embodiments, and by 20° C. or more in certain embodiments.

As another advantage, a polymeric coating layer can, in certain embodiments, can serve as a protective layer against corrosion and bird caging in the conductor. As can be appreciated, bare or liquid coated conductors can lose their structural integrity over time and can become vulnerable to bird caging in any spaces between the conductor wire strands. In contrast, conductor wires containing a polymeric coating layer are shielded and can eliminate bird caging problems.

As another advantage, in certain embodiments, a polymeric coating layer can eliminate water penetration, can reduce ice and dust accumulation, and can improve corona resistance.

As another advantage, in certain embodiments, a conductor coated with a polymeric coating layer can have increased heat conductivity and emissivity, and decreased absorptivity characteristics. For example, in certain embodiments, such conductors can have an emissivity (E) of 0.7 or more and can have an absorptivity (A) of 0.6 or less. In certain embodiments, E can be 0.8 or greater; and in certain embodiments, E can be 0.9 or greater. Such properties can allow a conductor to operate at reduced temperatures. Table 1, below, depicts the emissivity of several conductors including a bare conductor and two conductors with a polymeric coating layer. As depicted in Table 1, polymeric coating layer improves the emissivity of the cable.

TABLE 1

| Sample Name | Emissivity (ASTM E408) |
|---|---|
| Bare conductor | 0.16 |
| Conductor coated with XLPE + 2.5 wt % carbon black | 0.88 |
| Conductor coated with PVDF | 0.89 |

As an additional advantage, in certain embodiments, a polymeric coating can have a thermal deformation resistance at higher temperatures, including temperatures of 100° C. or more, and in certain embodiments 130° C. or more. Advantageously, however, the polymeric coating can maintain flexibility at lower temperatures, and can have improved shrink back, and low thermal expansion at the lower temperature range.

Finally, the addition of a polymeric coating layer can add relatively little weight to an overhead conductor. For example, in certain embodiments, the weight increase of a coated overhead conductor compared to a bare conductor can be 20% or less in certain embodiments, 10% or less in certain embodiments, and 5% or less in certain embodiments.

Examples

Table 2 depicts the temperature reduction of coated overhead conductors having a polymeric coating layer in comparison to uncoated bare conductors. Polymeric coating layers constructed from PVDF (Sample 1) and XLPE (Sample 2) were applied using a melt extrusion process. The temperature reduction was measured on the conductor while applying current using the experimental setup depicted in FIG. 6.

TABLE 2

| Sample | Coating | Current Applied | Bare conductor | Coated Conductor | Reduction in temperature |
|---|---|---|---|---|---|
| Sample 1 | PVDF | 204 | 92 | 77.5 | 14.5 |
| Sample 2 | XLPE | 740 | 128.4 | 99.8 | 28.6 |

Temperature Reduction Measurements

Figure 6:
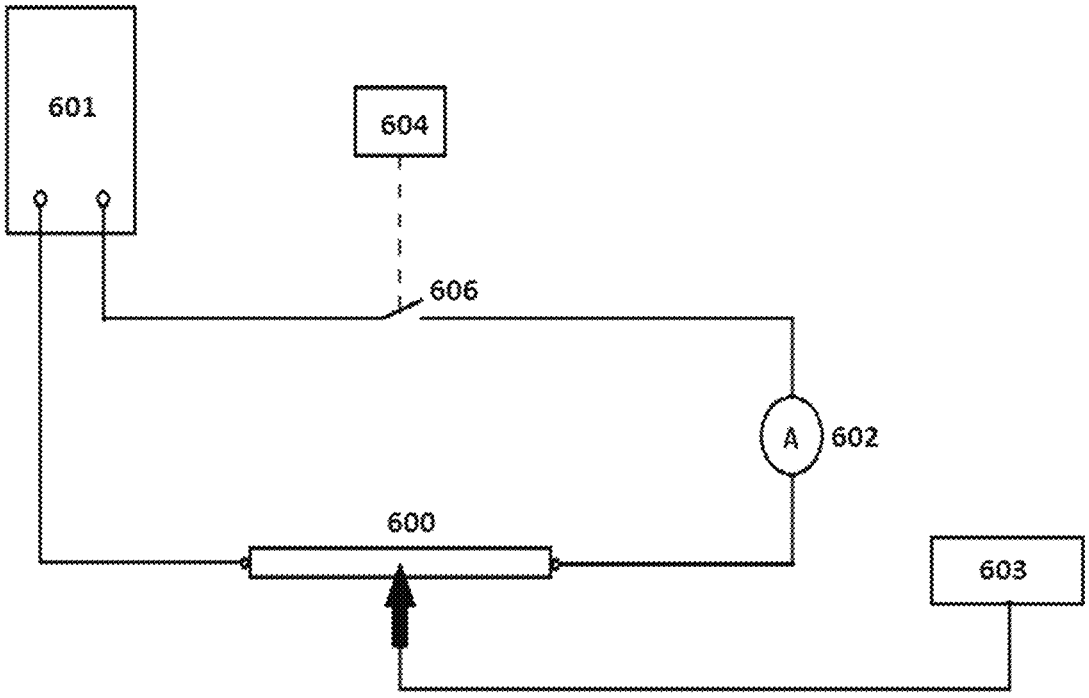
FIG. 6 schematically depicts an experimental setup to measure the temperature reduction of a conductor according to one embodiment.

The test apparatus used to measure temperature reduction of cable samples in Table 2 is depicted in FIG. 6 and consists of a 60 Hz AC current source 601, a true RMS clamp-on current meter 602, a temperature datalog device 603 and a timer 604. Testing of each sample 600 conducted within a 68" wide×33" deep windowed safety enclosure to control air movement around the sample. An exhaust hood (not shown) was located 64" above the test apparatus for ventilation.

The sample 600 to be tested was connected in series with an AC current source 601 through a relay contact 606 controlled by the timer 604. The timer 604 was used to activate the current source 601 and control the time duration of the test. The 60 Hz AC current flowing through the sample was monitored by a true RMS clamp-on current meter 602. A thermocouple 607 was used to measure the surface temperature of the sample 600. Using a spring clamp (not shown), the tip of the thermocouple 607 was kept firmly in contacted with the center surface of the sample 600. In case of measurement on a coated sample 600, the coating was removed at the area where thermocouple made the contact with the sample to get accurate measurement of the temperature of the substrate. The thermocouple temperature was monitored by a datalog recording device 603 to provide a continuous record of temperature change.

Weight Increase and Operating Temperature

Table 3 depicts the temperature effect caused by varying the thickness of an XLPE polymeric layer. Table 3 further depicts the weight increase caused by such variation. 250 kcmil conductors were used in each of the examples in Table 3. As illustrated in Table 3, an increase in the polymeric layer thickness can generally causes a decrease in operating temperature but at the cost of an increase in weight.

Figure 7:
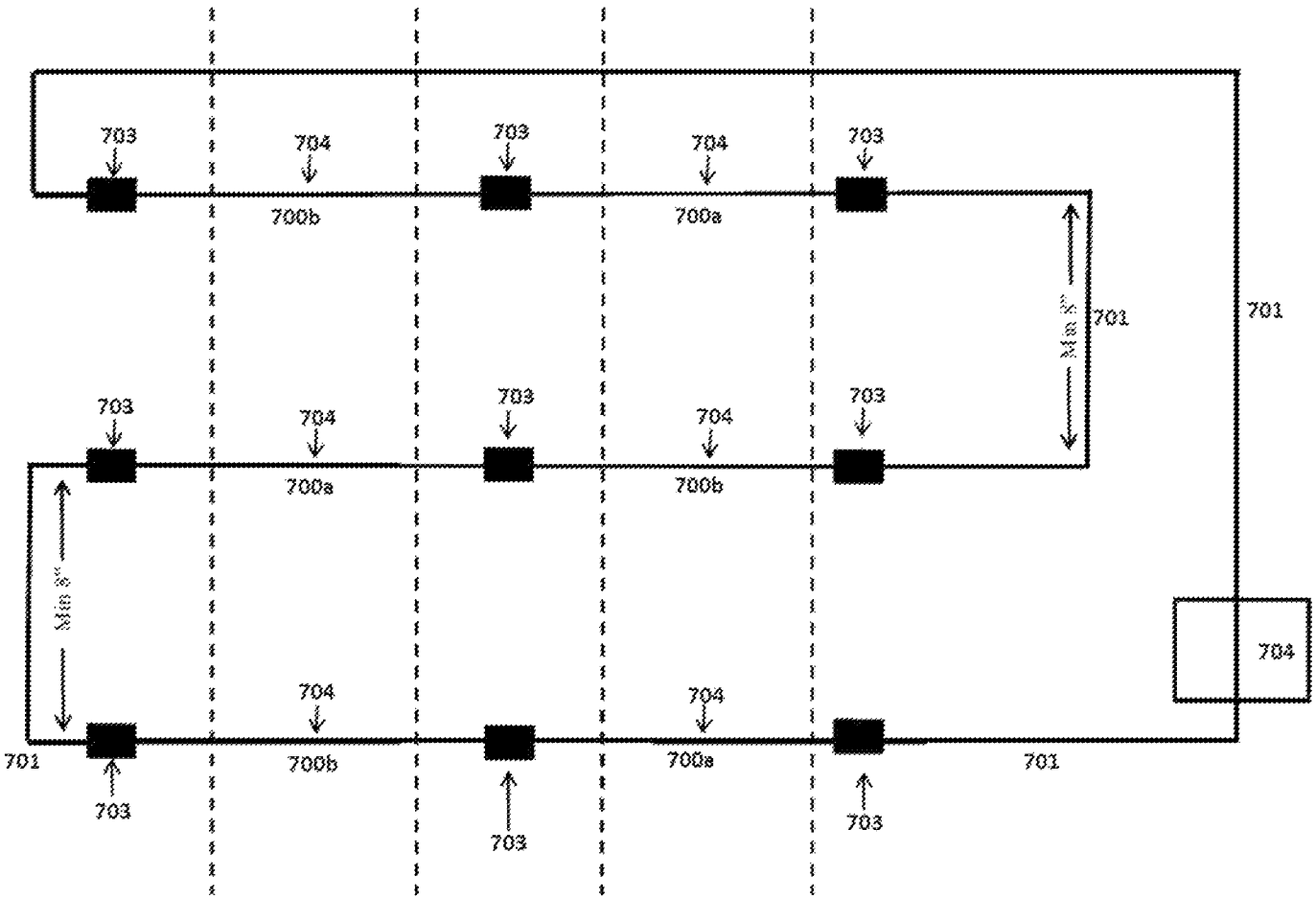
FIG. 7 depicts a schematic view of a series loop to evaluate a temperature difference between two different power cable coatings according to one embodiment.

The operating temperature of each sample in Table 3 was measured using a modified ANSI test depicted in FIG. 7. The modified ANSI test sets up a series loop using six, identically sized, four-foot cable specimens (700*a* or 700*b*) and four transfer cables 701 as depicted in FIG. 7. Three of the four-foot cable specimens (700*a* or 700*b*) are coated with conventional insulation materials (700*a*) and three of the four-foot cable specimens (700*b*) are coated with a polymeric layer as described herein. As illustrated by FIG. 7, two alternating sets are formed with each set having three cable specimens. Equalizers 703 (e.g., shown as bolt separators in FIG. 7) are placed between each cable specimen to provide equipotential planes for resistance measurements and ensure permanent contacts between all cable specimens. Each equalizer 703 has a formed hole matching the gauge of the cable specimens (700*a* or 700*b*) and each cable specimen (700*a* or 700*b*) is welded into the holes. Temperature was measured on the conductor surface of each cable specimen at locations '704' in FIG. 7 while supplying constant current and voltage from a transformer 704.

TABLE 3

| | Thickness of Insulation | | | | | | | |
|---|---|---|---|---|---|---|---|---|
| | Bare | 25 mils | 30 mils | 40 mils | 80 mils | 90 mils | 100 mils | Ambient |
| Temperature (° C.) | 107.58 | 72.4 | 71.68 | 71.78 | 70.14 | 70.74 | 69.92 | 22.22 |
| % weight increase | — | 6.9 | 8.2 | 11.3 | 22.4 | 25.2 | 28.2 | — |

Polymeric Coating Layer Formulation

Table 4 depicts several polymeric coating compositions. Each of Examples 1 to 5 demonstrates properties suitable for use as polymeric layers of the present disclosure.

TABLE 4

| Component | Example 1 | Example 2 | Example 3 | Example 4 | Example 5 |
|---|---|---|---|---|---|
| PVDF | 97.5 wt % | — | — | — | — |
| XLPE | — | 96 wt % | 96 wt % | 95 wt % | — |
| Polyethylene | — | — | — | — | 63 wt % |
| ETFE | — | — | — | — | 32.5 wt % |
| Carbon black | — | 2.5 wt % | — | — | — |

TABLE 4-continued

| Component | Example 1 | Example 2 | Example 3 | Example 4 | Example 5 |
|---|---|---|---|---|---|
| Single wall carbon nanotube (SWCNT) | 2.5 wt % | — | — | 2.5 wt % | — |
| Infrared reflective additive | — | 1.5 wt % | 1.5 wt % | 1.5 wt % | 1.5 wt % |
| Zinc oxide | — | — | 2.5 wt % | — | — |
| Antioxidant | — | — | — | 1 wt % | 1 wt % |
| Peroxide | — | — | — | — | 2 wt % |

The dimensions and values disclosed herein are not to be understood as being strictly limited to the exact numerical values recited. Instead, unless otherwise specified, each such dimension is intended to mean both the recited value and a functionally equivalent range surrounding that value.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Every document cited herein, including any cross-referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests, or discloses any such invention. Further, to the extent that any meaning or definition of a term in this document conflicts with any meaning or definition of the same term in a document incorporated by reference, the meaning or definition assigned to that term in the document shall govern.

The foregoing description of embodiments and examples has been presented for purposes of description. It is not intended to be exhaustive or limiting to the forms described. Numerous modifications are possible in light of the above teachings. Some of those modifications have been discussed and others will be understood by those skilled in the art. The embodiments were chosen and described for illustration of various embodiments. The scope is, of course, not limited to the examples or embodiments set forth herein, but can be employed in any number of applications and equivalent articles by those of ordinary skill in the art. Rather it is hereby intended the scope be defined by the claims appended hereto.

What is claimed is:

1. A method of increasing the emissivity of an overhead conductor to lower its operating temperature, the method comprising:

surrounding an overhead conductor with a polymer composition, wherein the polymer composition comprises one or more of polyvinylidene difluoride and a cross-linked polyethylene, and wherein the polymer composition is essentially solvent free; and cooling the polymer composition to form a polymeric coating layer surrounding the overhead conductor; and wherein the polymeric coating layer contacts at least a portion of the overhead conductor and defines a single outer layer having a thickness of about 10 microns to about 1,000 microns and the overhead conductor operates at a lower temperature than a bare overhead conductor when tested in accordance with ANSI C119.4; and wherein the method is continuous; and wherein an externally applied pressure is applied to the overhead conductor during at least one of surrounding the overhead conductor with the polymer composition or cooling the polymer composition, wherein the externally applied pressure is applied from a hot air circular knife.

2. The method of claim 1, wherein the surrounding the overhead conductor with the polymer composition further comprises heating the polymer composition and extruding the polymer composition around the overhead conductor.

3. The method of claim 1, wherein the surrounding the overhead conductor with the polymer composition further comprises spraying a powder comprising the polymer composition around an exterior surface of the overhead conductor and then melting the powder.

4. The method of claim 1, wherein the overhead conductor is pre-heated prior to surrounding the overhead conductor with the polymer composition.

5. The method of claim 1, wherein the polymeric coating layer is a conformal coating layer and is in contact with an outer contour of the overhead conductor.

6. The method of claim 5, wherein unfilled spaces between the polymeric coating layer and the outer contour of the overhead conductor are at least partially filled.

7. The method of claim 1, wherein the polymer composition further comprises one or more of polypropylene, fluoroethylene vinyl ether, silicone, acrylic, polymethyl pentene, poly(ethylene-co-tetrafluoroethylene), polytetrafluoroethylene, and copolymers thereof.

8. The method of claim 1, wherein the polymer composition further comprises about 50%, or less, filler, and the filler comprises one of carbon black or a conductive carbon nanotube.

9. The method of claim 1, wherein the polymeric coating layer is semi-conductive and has a volume resistivity of less than $10^{10}$ ohm-cm.

10. The method of claim 1, wherein the polymeric coating layer has a retention of elongation at break of 50%, or more, after 2,000 hours of exterior weather when tested in accordance with ASTM 1960.

11. The method of claim 1, wherein the polymeric coating layer has a thickness of about 10 microns to about 500 microns.

12. The method of claim 1, wherein the polymeric coating layer has an emissivity of 0.80 or greater.

13. The method of claim 1, wherein the polymeric coating layer has a solar absorptivity of 0.3 or less.

14. The method of claim 1, wherein the polymeric coating layer has a heat conductivity or 0.15 W/mK or greater.

15. The method of claim 1, wherein the polymer composition is at least partially cross-linked.

16. The method of claim 1, wherein the polymer composition is thermoplastic and has a melting temperature of 140° C. or more.

* * * * *